United States Patent [19]

Nakamura

[11] Patent Number: 4,709,741

[45] Date of Patent: Dec. 1, 1987

[54] MOLD MATERIAL AND PROCESS FOR CASTING OF PURE TITANIUM OR TITANIUM ALLOY

[75] Inventor: Seizo Nakamura, Osaka, Japan

[73] Assignee: Ohara Co., Ltd., Osaka, Japan

[21] Appl. No.: 803,447

[22] Filed: Dec. 2, 1985

[30] Foreign Application Priority Data

Dec. 4, 1984 [JP] Japan ..... 59-257154
Mar. 22, 1985 [JP] Japan ..... 60-58706
Mar. 22, 1985 [JP] Japan ..... 60-58705

[51] Int. Cl.[4] ..... B22C 1/00

[52] U.S. Cl. ..... 164/35; 164/529; 106/38.3; 106/38.9

[58] Field of Search ..... 164/34, 35, 517, 518, 164/519, 520, 521, 523, 524, 528, 529, 138; 106/38.2, 38.3, 38.9

[56] References Cited

U.S. PATENT DOCUMENTS 3,968,828 7/1976 Toeniskoetter et al. ..... 164/528
4,171,984 10/1979 Hosaka et al. ..... 106/38.3
4,209,056 6/1980 Gardikes et al. ..... 106/38.9
4,445,565 5/1984 Seeney et al. ..... 164/528
4,522,651 6/1985 Seeney et al. ..... 106/38.9

FOREIGN PATENT DOCUMENTS 1282111 7/1972 United Kingdom .
1435988 5/1976 United Kingdom .
1496356 12/1977 United Kingdom ..... 164/519
2070627 4/1983 United Kingdom .

*Primary Examiner*—Nicholas P. Godici
*Assistant Examiner*—Richard K. Seidel
*Attorney, Agent, or Firm*—Armstrong, Nikaido, Marmelstein & Kubovcik

[57] ABSTRACT

The present invention relates to a mold material for casting pure titanium or a titanium alloy which comprises one or more chief materials selected from among silica-alumina mixtures, mullite and spinel and a hardening agent comprising a phosphate and a basic metal oxide and a process for casting pure titanium or a titanium alloy by the use of said mold material. This mold material forms a refractory structure having a melting point higher than that of pure titanium or a titanium alloy therein to enable pure titanium which is unstable in a molten state to be cast stably.

2 Claims, No Drawings

MOLD MATERIAL AND PROCESS FOR CASTING OF PURE TITANIUM OR TITANIUM ALLOY

BACKGROUND OF THE INVENTION

1. Field of the Invention

The present invention relates to a mold material and a process for stably casting pure titanium or a titanium alloy whose properties are unstable in a molten state.

2. Description of the Prior Art

Up to this time, a mold material comprising silica as a chief material and a phosphate and a basic metal oxide as a hardening agent has been used for casting various metals. Quartzite, quartz sand or the like has been used as such silica and ammonium phosphate or the like has been used as such a phosphate, while electromelting magnesia, magnesia clinker or the like has been used as such a basic metal oxide.

The casting of a metal by the use of the above mold material of the prior art is generally carried out by firing a mixture of the chief material and the hardening agent at 800° to 900° C. to prepare a mold and casting a molten metal into the mold kept at this temperature.

Most of metals of the prior art have a melting point of up to about 1400° C. Representatively, cobalt-chromium alloy, nickel-chromium alloy or the like has a melting point of 1300° to 1400° C. Particularly, a dental metal has a melting point of up to about 1400° C. Accordingly, the above-described mold material containing silica having a melting point of 1550° to 1600° C. as a chief material can be sufficiently used for casting these metals. However, pure titanium or a titanium alloy has a melting point of 1600° to 1700° C., which exceeds the melting point of the above mold material containing silica as a chief material. Accordingly, when titanium which is unstable in a molten state is cast by the use of the above mold material, the pure titanium or titanium alloy is bonded to oxygen contained in the silica to form titanium oxide, so that the obtained product does not exhibit the inherent characteristics of pure titanium or titanium alloy and is not fit for use because of the deterioration of the metal due to oxidation, the seizing of the surface of the product and the like.

SUMMARY OF THE INVENTION

The present invention aims at providing a mold material and a process for casting pure titanium or a titanium alloy while taking into account the relationship between the melting point of the mold material of the prior art and that of pure titanium or a titanium alloy. Particularly, it aims at providing a mold material for casting pure titanium or a titanium alloy without oxidation nor changes in properties of the metal which is caused by the reaction of the metal with a component contained in the mold material, while the metal in a state molten at 1600° to 1700° C. is cast therein and a process using said mold material. More particularly, though the process using the mold material of the prior art comprises casting a molten metal into a casting space of a mold kept at several hundreds of ° C., the present invention aims at providing a process which comprises casting a molten metal into a casting space of a mold kept at an ordinary temperature, which simplifies the handling of the mold material and the operation of casting.

To attain these aims, the inventors of the present invention have investigated to provide a mold material which can be sufficiently used at a melting point of pure titanium or a titanium alloy and in which such a metal can be cast at an ordinary temperature and a casting process using said mold material and have accomplished the present invention.

DETAILED DESCRIPTION OF PREFERRED EMBODIMENTS

The present invention relates to a mold material comprising a chief material containing one or more numbers selected from among silica - alumina mixture, mullite and spinel as a main component and a hardening agent comprising a phosphate and a basic metal oxide and a process for casting using said mold material. The silica to be used in the present invention may be any ordinary one used as a mold material for casting a molten metal. Examples of the silica include quartzite, quartz sand, granular quartz sand, cristobalite and mixtures thereof. The purity of the silica component is preferably 90% or above, more preferably 95% or above. Generally, silica contains ferric oxide, aluminum oxide, calcium oxide and the like as an impurity, among which aluminum oxide, i.e. alumina has no influence upon the molten titanium in the mold, but ferric oxide and calcium oxide are highly reactive with titanium. Therefore, the purity of the silica must be 90% or above.

The alumina component to be used in the present invention may be selected from among highpurity alumina and minerals containing alumina in a high ratio, while ones having a purity of 80% or above, particularly 90% or above, are preferred. These alumina components also contain silicon oxide, calcium oxide, ferric oxide, manganese oxide, sodium oxide, potassium oxide and the like as an impurity. Among these impurities, those other than silicon oxide, i.e., silica are highly reactive with titanium. Accordingly, if a large amount of these impurities are contained in the alumina component, the reaction of the mold material with titanium will become a problem similarly to the case of the above silica component.

Generally, alumina-containing minerals having a purity of 85% or above, such as diaspore or boehmite, may be used as said alumina component. Particularly, when an alumina component having a high purity of 90% or above is used, the reaction of the metal with the mold material will be depressed to a minimum level.

The mullite to be used as a chief material in the present invention is a mineral having a composition of $3Al_2O_3 \cdot 2SiO_2$. It can be prepared by heating a natural aluminosilicate mineral or an aluminosilicate clay mineral to carry out transition into mullite having a melting point of a slightly less than 1900° C. The spinel to be used as a chief material in the present invention is a magnesium-aluminium oxide represented by the formula $MgO \cdot Al_2O_3$ and having a melting point of 2135° C.

According to the present invention, a phosphate and a basic metal oxide are used as a hardening agent for the above described chief material. Though the phosphate is generally ammonium phosphate, it may be suitably selected from among sodium phosphate, aluminum phosphate, magnesium phosphate, calcium phosphate, potassium phosphate and the like. Ammonium phosphate as the preferred phosphate, however, has a characteristic of so-called solidification expansion, i.e. it expands on hardening, while pure titanium or a titanium alloy shrinks on hardening during casting. Thus a mold material for casting such a metal is required to expand on hardening to such an extent as to set off the shrinkage. Taking this requirement into consideration, ammonium phosphate is preferred as a mold material for casting pure titanium or a titanium alloy according to the present invention, because it is characterized by solidification expansion. Since, however, some of the above-described phosphates can not exhibit solidification expansion, it is necessary when using such a phosphate in the preparation of a mold that the casting space be designed to be slightly larger than the desired actual size.

The basic metal oxide to be used as a hardening agent may be selected from among magnesium oxide, electromelting magnesia, magnesia clinker or the like. Magnesia has such a high melting point of about 2800° C. that it is sufficiently refractory to be used as a mold material for casting pure titanium or a titanium alloy.

According to the present invention, the above chief material and the above hardening agent are used together with a grinding fluid in the casting of pure titanium or the like. Generally, colloidal silica is used as the grinding fluid with view to enhancing the strength of the mold and causing solidification expansion. A colloidal silica having a silica content of 20 to 40% is generally used, because such a silica is commercially available and the selection of such a silica is economically advantageous. However, the use of colloidal silica having a silica content of more than 40% is not hindered.

As described above, the mold material for casting pure titanium or a titanium alloy according to the present invention comprises a chief material containing silica and alumina as a main component and a hardening agent comprising a phosphate and a basic metal oxide and the mold material is used together with colloidal silica as a grinding fluid. It is preferred that the mold material comprises 90 to 55% by weight of a mixture of silica and alumina as a chief material, 5 to 15% by weight of a phosphate and 5 to 30% by weight of a basic metal oxide. If the amount of the mixture of silica and alumina exceeds 90%, the phosphate and the basic metal oxide can not be present each in an amount of at least 5%, thus resulting in an insufficient solidification expansion. If the amount is less than 55%, in other words, if the total amount of the phosphate and the basic metal oxide is 45% or above, the solidification expansion will be too large and the surface of the product will be roughened. Accordingly, the total amount of silica and alumina must not be less than 55% by weight. Further, the amount of the phosphate used as a hardening agent must be 5 to 15% by weight. If it is less than 5% by weight, the solidification expansion will be insufficient and the dimensional accuracy will be problematic. On the contrary, if it exceeds 15% by weight, the solidification expansion will be so large that abnormal expansion will occur and the surface of the product will be remarkably roughened. Furthermore, the amount of the basic metal oxide used must be 5 to 30% by weight. If it is less than 5% by weight, the reaction with the phosphate will not be sufficient to result in an insufficient strength of the mold and the prolongation of hardening time, which lowers the workability. On the contrary, if it exceeds 30% by weight, the hardening time will be too short to control the reaction with the phosphate.

As described above, the combination of silica, alumina and a hardening agent comprising a phosphate and a basic metal oxide is used as one of the mold materials for casting pure titanium or a titanium alloy according to the present invention.

The amounts of silica and alumina used must be each at least 10% based on the amount of the mixture. For example, if the amount of silica is less than 10%, a mold prepared by burying a wax pattern in the mold material and removing the wax pattern by heating at 100° to 150° C. will be disadvantageous in that the surface of the casting space will be roughened to cause the roughening of the surface of the product. On the contrary, an amount of alumina of less than 10% is insufficient for a mullite or spinel structure to be sufficiently formed by the reaction with silica, thus giving a poorly heat-resistant mold. It is practically preferred to use silica and alumina each in an amount of at least 20% based on the total amount of the both.

The chief material comprising silica and alumina according to the present invention has characteristics that it forms a structure of mullite (m.p.: about 1850° C.), spinel (m.p.: about 2135° C.) or cordierite (m.p.: about 2000° C.) when heating. Therefore, when a mixture of silica and alumina is used as a chief material for a mold, at least one of the above structures is formed in the chief material, so that titanium or a titanium alloy will not be oxidized by the bonding with oxygen molecules contained in the material and neither discoloration nor roughening of the surface of the product occurs, because of both the high melting point of the structure and the melting point of alumina higher than that of titanium or a titanium alloy (i.e. 2050° C.). When a mold is prepared from the above mold material, the mold must be subjected to heat treatment after hardening in order to form the above structure. A molten metal is cast in a mold in a state of the above-described structure at about 1400° C. similarly to the case of a mold containing silica as a main component of the prior art. Therefore, no product of mullite, spinel or cordierite is necessary at all. Accordingly, when a mold material comprises a chief material containing silica and alumina as a main component and a hardening agent comprising a phosphate and a basic metal oxide, pure titanium or a titanium alloy in a molten state can be cast in the mold without suffering changes in its characteristics. Additionally, pure titanium or a titanium alloy shrinks on hardening, while the mold made from a material containing silica and slumina of the present invention expands both on heating and on solidification. Further, the total extent of the expansion of the mold is almost equivalent to the extent of the shrinkage of pure titanium or a titanium alloy. Therefore, when a wax pattern having the same size as that of a final product is buried in the mold, the expansion sets off against the shrinkage to give an appropriate casting space.

As described above, a mixture of silica and alumina is used as a chief material in the present invention. Further, it is possible to replace part (i.e. 5 to 50% by weight) of the mixture with zirconium oxide and/or zircon. The replacement with zirconium oxide and/or zircon which has a melting point higher than that of titanium (about 2850° C.) is effective in enhancing the refractoriness of the chief material comprising silica and alumina and preventing the seizing in the casting of the titanium. Further, when zirconium oxide or zircon is added in an amount of 20 to 30% by weight, the formation of cordierite is promoted even at the same firing temperature and the denseness of the fired structure is enhanced. The amount of zirconium oxide or zircon must be 5 to 50% by weight. If it is less than 5% by weight, the state of the surface of the product and the generation of cavity will be almost equivalent to those in the case where no zirconium oxide or zircon is added. On the contrary, if it exceeds 50% by weight, the roughness on the surface of the product will be remarkable and the dimensional accuracy of the product will be lowered.

Now, the cases where mullite or spinel is used as a mold material will be described. Similarly to the case where silica and alumina are used as a mold material, the mold material used in this case comprises a chief material containing mullite or spinel as a main component and a hardening agent comprising a phosphate and a basic metal oxide and the mold material is used together with colloidal silica as a grinding fluid in practical use. The amount of mullite or spinel used as a chief material must be 95 to 55% by weight and that of the phosphate used as a hardening agent must be 2.5 to 15% by weight, while that of the basic metal oxide used as a hardening agent must be 2.5 to 30% by weight. If the amount of mullite or spinel used as a chief material exceeds 95% by weight, the phosphate and the basic metal oxide can not be present each in an amount of at least 2.5% by weight (with a total amount of at least 5.0% by weight), so that the solidification expansion will be insufficient. Accordingly, the amount of mullite or spinel must be 95% by weight or below. On the contrary, if the amount is less than 55% by weight, in other words, if the total amount of the phosphate and the basic metal oxide exceeds 45% by weight, the solidification expansion will be too high and the roughness of the surface of the product will be remarkable. Accordingly, the amount of the mullite or spinel must be at least 55% by weight. The amount of the phosphate used as a hardening agent must be 2.5 to 15% by weight. If it is less than 2.5% by weight, the solidification expansion will be insufficient and the dimensional accuracy will be problematic, while if it exceeds 15% by weight, the solidification expansion will be so remarkable that abnormal expansion will occur and the roughness of the surface of the product will be remarkable. Further, the amount of the basic metal oxide must be 2.5 to 30% by weight. If it is less than 2.5% by weight, the reaction with the phosphate will be insufficient, so that the strength of the mold will be insufficient and the hardening time will be prolonged to lower the workability. On the contrary, if it exceeds 30% by weight, the hardening time will be too short to control the reaction with the phosphate.

As described above, the combination of a chief material comprising mullite or spinel and a hardening agent comprising a phosphate and a basic metal oxide is used as one of the mold materials for casting pure titanium or a titanium alloy according to the present invention.

When mullite or spinel is used as a chief material of a mold for casting pure titanium or a titanium alloy, an aggregate of mullite (of m.p. of 1850° C.) or spinel (of m.p. of 2135° C.), the melting point of which is higher than that of titanium, i.e., 1600° to 1700° C., is formed in the mold material by heat treatment, so that such a metal will not be oxidized with oxygen molecule contained in the mold material and neither discoloration nor roughening of the surface of the product occurs. Accordingly, when a mold material for casting pure titanium or a titanium alloy in a molten state comprises a chief material containing mullite or spinel as a main component and a hardening agent comprising a phosphate and a basic metal oxide, the casting can be carried out without changes in the characteristics of titanium. Additionally, pure titanium or a titanium alloy shrinks on hardening, while the above mold expands both on heating and on solidifying. Further the total extent of the expansion of the mold is almost equivalent to the extent of the shrinkage of pure titanium or a titanium alloy in cooling. Therefore, when a wax pattern having the same size as that of a final product is buried in the mold material, the expansion sets off against the shrinkage, thus obtaining an appropriate casting space.

Now, a general process for preparing a mold from the mold material of the present invention and a process for casting by the use of the mold will be described.

(1) Silica-alumina mold material

A mixture comprising 10 to 82% by weight of silica, 10 to 82% by weight of alumina, 5 to 15% by weight of a phosphate and 5 to 30% by weight of magnesium oxide as a basic metal oxide is ground together with colloidal silica having a silica content of 20 to 40% by weight, or water. The ground mixture is packed into a container, while a wax pattern is placed in the container, followed by spontaneous hardening.

The above procedure is similar to the one of the prior art, for example, the procedure for casting a dental metal.

According to the present invention, after the hardened mold has been heated to remove the wax pattern, the mold is further fired by a proper method, for example, by heating it to 900° C. or above, preferably to about 1200° C., in an electric oven. The fired mold is cooled to an ordinary temperature and used for casting. Generally, the mold can be used for casting at 400° C. or below. Though most of the molds of the prior art are used in a heated state, the mold of the present invention is used for casting in a cooled state, that is, in an ordinary state. Accordingly, the mold of the present invention must have a melting point higher than that of a molten metal to be cast and the properties of the mold must be stable.

The process for the preparation of a mold of the prior art contains removal of a wax pattern at 100° to 200° C., that of ammonia gas at 400° to 900° C. and that of phosphorus pentaoxide gas at 700° to 900° C.

According to the present invention, the mold is fired at a temperature higher than these temperatures, that is, at 900° C. or above to cause the bonding of silica to alumina, thus forming a refractory structure of mullite, spinel or cordierite in the mold material. Thus, a mold which satisfies the requirements for casting pure titanium or a titanium alloy having the above-described melting point can be obtained.

As described above, the mold prepared from the mold material containing silica and alumina as a chief material is suited for use in casting pure titanium or a titanium alloy, not only because the melting point of alumina is higher than that of pure titanium or a titanium alloy and silica is suitable for use by considering the casting time, but also because the refractory structure such as mullite or the like is formed by firing as described above, particularly on the surface of the mold and the casting space, so that silica is present in an inner part of the mold, thus overcoming the problem of heat resistance.

The process for casting pure titanium or a titanium alloy by the use of the above mold comprises the steps of melting titanium and casting the molten metal into the casting space of the mold.

The melting of titanium, for example, dental titanium, is carried out as follows: About 40 g of a pure titanium ingot is placed in a crucible made of magnesium oxide (MgO), zirconium oxide ($ZrO_2$) or copper having a purity of 95% or above and fitted with a positive electrode made of tungsten rod, the top of which is exposed on the bottom of the crucible to cotact the ingot with the positive electrode. A negative electrode made of a tangsten rod is placed in the vacant space in the upper part of the crucible. Argon gas is introduced into the crucible from around the negative electrode with a view to stabilizing the arc and preventing the oxidation of titanium. An arc is generated between the negative electrode placed in the upper part of the crucible and the positive electrode placed in the lower part of the crucible with a dissolution current of 150 to 200A (DC) to melt the ingot in the crucible, thus obtaining molten titanium for casting. It is preferred to tilt the negative electrode against the crucible during the melting to prevent partial over-heating, thus melting the ingot homegeneously.

The casting of the molten titanium into a mold prepared from the above mold material is carried out by a centrifugal casting machine or a compression casting machine according to an ordinary method. Preferred centrifugal casting machines to be used in this step are ones which generate a centrifugal force by the rotation of the longitudinal direction, have a radius of 20 cm and can rotate at 700 rpm or above. Preferred compression casting machines to be used in this step are ones which cast a molten metal by the use of an inert gas (such as argon or the like) having a pressure of 3 to 8 kg/cm$^2$.

(2) Mullite or spinel mold material

A mixture comprising 55 to 95% by weight of mullite or spinel as a chief material, 2.5 to 15% by weight of a phosphate and 2.5 to 30% by weight of magnesium oxide as a basic metal oxide is ground together with colloidal silica having a silica content of 20 to 40% by weight or water. The ground mixture is placed in a container, while a wax pattern is buried in the container, followed by spontaneous hardening.

The other procedures and conditions are the same as those in the case of the silica-alumina mold material.

Now, the following Experimental Examples will describe the preparation of molds from the mold material of the present invention and the casting of pure titanium or a titanium alloy by the use of the molds. Their results will be shown below.

EXPERIMENTAL EXAMPLE 1

A mixture comprising 80% by weight of a chief material and 20% by weight of a hardening agent was ground together with water in vacuum. According to the ordinary procedure of the prior art, a wax pattern was buried in the resulting mixture to obtain a mold. The mold was hardened, fired in an electric oven at 1200° C. and cooled to an ordinary temperature. Molten pure titanium was cast in the mold. The results are shown in Table 1, wherein the total amount of silica and alumina used is 100% and the hardening agent used in an amount of 20% by weight comprises 12% by weight of ammonium phosphate and 8% by weight of magnesia.

In the column of judgement, marks "o" and "Δ" mean "usable", while mark "x" means "difficult to use". The same applies also in Experimental Examples 2 to 13.

TABLE 1

| Chief material | | | | | | | | |
|---|---|---|---|---|---|---|---|---|
| Amt. of silica (% by weight) | Amt. of alumina (% by weight) | Hardening agent (% by weight) | Mold strength | Casting surface | Tensile strength (kg/mm$^2$) | Elongation (%) | Hardness (HB) | Judgement |
| 100 | 0 | 20 | usable | seizing | 55 | 5 | 240 | x |
| 90 | 10 | " | " | good | 60 | 6 | 220 | Δ |
| 80 | 20 | " | " | " | 73 | 10 | 210 | |
| 70 | 30 | " | " | " | 73 | 10 | 190 | |
| 60 | 40 | " | " | " | 70 | 12 | 190 | |
| 50 | 50 | " | " | " | 64 | 12 | 170 | |
| 40 | 60 | " | " | " | 65 | 12 | 170 | |
| 30 | 70 | " | " | " | 55 | 15 | 160 | |
| 20 | 80 | " | " | " | 55 | 15 | 160 | |
| 10 | 90 | " | Δslightly brittle but usable | roughening | 55 | 15 | 160 | Δ |
| 0 | 100 | " | xbrittle | " | 45 | — | — | x |

(note 1) The tensile strength was determined by the use of a rod having a diameter of 2 mm and a length of 20 cm obtained in Experimental Example 1. (note 2) The hardness was determined by the use of a plate having a thickness of 3 mm and an area of 2 cm$^2$ obtained in Experimental Example 1 according to Brinell hardness test.

EXPERIMENTAL EXAMPLE 2

A mixture comprising 55% by weight of a chief material and 45% by weight of a hardening agent was ground together with water in vacuum. According to an ordinary method, a wax pattern was buried in the resulting mold material to form a mold. The mold was hardened, fired in an electric oven at 1200° C. and cooled to an ordinary temperature. Molten pure titanium was cast in the mold. The results are shown in Table 2.

In Table 2, the total amount of silica and alumina used is 100% and the hardening agent used in an amount of 45% comprises 15% by weight of ammonium phosphate and 30% by weight of magnesia.

TABLE 2

| Chief material | | | | | | | | |
|---|---|---|---|---|---|---|---|---|
| Amt. of silica (% by weight) | Amt. of alumina (% by weight) | Hardening agent (% by weight) | Mold strength | Casting surface | Tensile strength (kg/mm²) | Elongation (%) | Hardness (HB) | Judgement |
| 100 | 0 | 45 | usable | seizing | 45 | 4 | 260 | x |
| 90 | 10 | " | " | slight seizing | 55 | 5 | 240 | Δ |
| 80 | 20 | " | " | good | 60 | 7 | 230 | |
| 70 | 30 | " | " | " | 70 | 10 | 210 | |
| 50 | 50 | " | " | " | 73 | 10 | 210 | |
| 30 | 70 | " | " | " | 70 | 10 | 210 | |
| 20 | 80 | " | " | " | 70 | 10 | 210 | |
| 10 | 90 | " | " | " | 60 | 13 | 190 | Δ |
| 0 | 100 | " | slightly brittle | roughening | 50 | 15 | 170 | x |

EXPERIMENTAL EXAMPLE 3

A mixture comprising 40% by weight of a chief material and 60% by weight of a hardening agent was ground together with water in vacuum. According to the ordinary procedure of the prior art, a wax patten was buried in the resulting mixture to form a mold. The mold was hardened, fired in an electric oven at 1200° C. and cooled to an ordinary temperature. Molten pure titanium was cast in the mold. The results are shown in Table 3.

In Table 3, the total amount of silica and alumina used is 100% and the hardening agent used in an amount of 60% comprises 20% by weight of ammonium phosphate and 30% by weight of magnesia.

TABLE 3

| Chief material | | | | | | | | |
|---|---|---|---|---|---|---|---|---|
| Amt. of silica (% by weight) | Amt. of alumina (% by weight) | Hardening agent (% by weight) | Mold strength | Casting surface | Tensile strength (kg/mm²) | Elongation (%) | Hardness (HB) | Judgement |
| 100 | 0 | 60 | usable | seizing | 30 | 1 | 280 | x |
| 90 | 10 | " | " | " | 35 | 2 | 280 | x |
| 80 | 20 | " | " | " | 40 | 3 | 260 | x |
| 50 | 50 | " | " | " | 40 | 3 | 260 | x |
| 20 | 80 | " | " | " | 45 | 3 | 260 | x |
| 10 | 90 | " | " | " | 40 | 5 | 260 | x |
| 0 | 100 | " | " | " | 30 | 6 | 240 | x |

EXPERIMENTAL EXAMPLE 4

A mixture comprising 90% by weight of a chief material and 10% by weight of a hardening agent was ground together with water in vacuum. According to the ordinary procedure of the prior art, a wax pattern was buried in the resulting mixture to form a mold. The mold was hardened, fired in an electric oven at 1200° C. and cooled to an ordinary temperature. Molten pure titanium was cast in the mold. The results are shown in Table 4.

In Table 4, the total amount of silica and alumina used is 100% and the hardening agent used in an amount of 10% comprises 5% by weight of ammonium phosphate and 5% by weight of magnesia.

TABLE 4

| Chief material | | | | | | | | |
|---|---|---|---|---|---|---|---|---|
| Amt. of silica (% by weight) | Amt. of alumina (% by weight) | Hardening agent (% by weight) | Mold strength | Casting surface | Tensile strength (kg/mm²) | Elongation (%) | Hardness (HB) | Judgement |
| 100 | 0 | 10 | usable | seizing | 55 | 5 | 240 | x |
| 90 | 10 | " | " | good | 60 | 6 | 210 | |
| 80 | 20 | " | " | " | 73 | 10 | 210 | |
| 70 | 30 | " | " | " | 70 | 10 | 190 | |
| 50 | 50 | " | " | " | 70 | 12 | 190 | |
| 30 | 70 | " | " | " | 65 | 12 | 170 | |
| 20 | 80 | " | " | slight roughening | 55 | 15 | 160 | Δ |
| 10 | 90 | " | slightly brittle | slight roughening | 55 | 15 | 160 | Δ |
| 0 | 100 | " | brittle | roughening | 45 | — | — | x |

EXPERIMENTAL EXAMPLE 5

A mold prepared from a mold material comprising at least 90% by weight of a mixture of silica and alumina and at most 5% by weight of ammonium phosphate and at most 5% by weight of magnesia as a hardening agent exhibits good mechanical strengths such as tensile strength, elongation, hardness or the like. However, when such a mold is used for a dental metal, solidification expansion due to the at most 5% by weight of ammonium phosphate is too small to set off against the shrinkage of the metal (i.e. titanium) and the use of at most 5% by weight of magnesia can not impart a sufficient green strength to the mold, so that the roughening of the surface of the mold occurs during the removal of the wax pattern. For the above two reasons, such a mold is not suitable for a dental metal.

However, in the preparation of parts of general industries, the solidification expansion is not always necessary and it is possible to prepare a wax pattern in anticipation of the shrinkage of titanium used as a casting metal of 2 to 3%. Further, the roughening of the surface can be prevented by carrying out the removal of the wax pattern carefully and slowly. Accordingly, the mold prepared from a mold material containing a hardening agent in a total amount of 10% by weight or below is usable.

TABLE 5

| Chief material | | | | | | | |
|---|---|---|---|---|---|---|---|
| Amt. of silica (% by weight) | Amt. of alumina (% by weight) | Mold strength | Casting surface | Tensile strength (kg/mm$^2$) | Elongation (%) | Hardness (HB) | Judgement |
| 100 | 0 | usable | seizing | 55 | 5 | 240 | x |
| 90 | 10 | " | good | 60 | 8 | 220 | |
| 80 | 20 | " | " | 73 | 12 | 200 | |
| 70 | 30 | " | " | 73 | 12 | 200 | |
| 50 | 50 | " | " | 70 | 15 | 180 | |
| 30 | 70 | " | " | 60 | 15 | 170 | |
| 20 | 80 | slightly brittle | slight roughening | 60 | 15 | 160 | |
| 10 | 90 | slightly brittle | roughening | 55 | 15 | 160 | |
| 0 | 100 | brittle | " | 50 | — | — | x |

EXPERIMENTAL EXAMPLE 6

A mixture comprising 80% by weight of a chief material and 20% by weight of a hardening agent was ground together with colloidal silica or water in vacuum. According to the ordinary procedure of the prior art, a wax pattern was buried in the resulting mixture to prepare a mold. The mold was hardened, fired in an electric oven at 1200° C. and cooled to an ordinary temperature. A molten titanium alloy (Ti-6Al-4V) was cast in the mold. The results are shown in Table 6. In Table 6, the total amount of silica and alumina used is 100% and the hardening agent used in an amount of 20% by weight comprises 12% by weight of ammonium phosphate and 8% by weight of magnesia.

TABLE 6

| Chief material | | | | | | | | |
|---|---|---|---|---|---|---|---|---|
| Amt. of silica (% by weight) | Amt. of alumina (% by weight) | Hardening agent (% by weight) | Mold strength | Casting surface | Tensile strength (kg/mm$^2$) | Elongation (%) | Hardness (HB) | Judgement |
| 100 | 0 | 20 | usable | seizing | 50 | 4 | 400 | x |
| 90 | 10 | " | " | good | 65 | 7 | 380 | Δ |
| 80 | 20 | " | " | " | 75 | 8 | 380 | |
| 60 | 40 | " | " | " | 85 | 9 | 360 | |
| 40 | 60 | " | " | " | 85 | 9 | 360 | |
| 20 | 80 | " | " | " | 80 | 10 | 340 | |
| 10 | 90 | " | slightly brittle but usable | slight roughening | 80 | 10 | 340 | |
| 0 | 100 | " | brittle | roughening | 70 | — | — | x |

EXPERIMENTAL EXAMPLE 7

A mixture comprising 90% by weight of a chief material comprising silica, alumina and zirconium oxide and 10% by weight of a hardening agent was ground together with water. According to the ordinary procedure of the prior art, a wax pattern was buried in the resulting mixture to prepare a mold. The mold was hardened, fired in an electric oven at 1200° C. and cooled to an ordinary temperature. Molten pure titanium was cast in the mold. The results are shown in Table 7.

In the column of judgement, "x" means "unusable", "Δ" means "slightly problematic but usable", "o" means "usable" and " " means "preferably usable".

TABLE 7

| Silica + alumina (% by weight) | Zirconium oxide (% by weight) | Color | Surface | Cavity (number) | Judgement |
|---|---|---|---|---|---|
| 100 | 0 | black | remarkable seizing but removable by sand blast | 6~7 | Δ |
| 90 | 10 | black | remarkable seizing but removable by sand blast | 3~4 | |
| 80 | 20 | gray | seizing but smooth | 2~3 | |
| 70 | 30 | gray | " | 2~3 | |
| 60 | 40 | gray | " | 2~3 | |
| 50 | 50 | gray | smooth | 2~3 | Δ |
| 40 | 60 | partially bluish | remarkable roughening | 1~2 | x |

TABLE 7-continued

| Silica + alumina (% by weight) | Zirconium oxide (% by weight) | Color | Surface | Cavity (number) | Judgement |
|---|---|---|---|---|---|
| 30 | 70 | partially bluish | remarkable roughening | 1~2 | x |

As shown in Table 7, at most 50% by weight of a chief material comprising silica and alumina can be replaced with zirconium oxide, while 10 to 40% by weight of the chief material is preferably replaced. The addition of zirconium oxide enhances the refractoriness of the mold, prevents the seizing and depresses the oxidation, the discoloration and the generation of cavity. This is presumably because zirconium oxide having a high melting point of 285° C. enhances the refractoriness of the whole of the mold material.

EXPERIMENTAL EXAMPLE 8

TABLE 8

| Mullite | Hardening agent (phosphate + basic metal oxide) | Mold strength | Casting surface | Tensile strength (kg/mm$^2$) | Elongation (%) | Hardness | Judgement |
|---|---|---|---|---|---|---|---|
| 100% | 0% | unusable | — | — | — | — | x |
| 95 | 5 | usable | no seizing | 75 | 14 | 190 | |
| 90 | 10 | " | " | 75 | 14 | 190 | |
| 80 | 20 | " | " | 70 | 13 | 190 | |
| 70 | 30 | " | " | 60 | 11 | 200 | |
| 60 | 40 | " | " | 55 | 10 | 210 | |
| 55 | 45 | " | " | 50 | 8 | 220 | |
| 50 | 50 | " | slight seizing | 50 | 6 | 240 | Δ |
| 45 | 55 | " | remarkable seizing | 40 | 5 | 260 | x |

Table 8 shows the mold strength, state of the surface, tensile strength, elongation, hardness and advisability of use with respect to a mold prepared from a mold material comprising 45 to 100% by weight of a chief material and the balance of a hardening agent.

In the column of judgement, "x" means "unusable", "o" means "usable" and "Δ" means "slightly problematic but usable". The same applies in the following Experimental Examples.

EXPERIMENTAL EXAMPLE 9

A mixture comprising 90% by weight of a chief material and 10% by weight of a hardening agent was ground together with water in vacuum. A wax pattern having a form of a rectangular parallelepiped having a width of 20 mm, a depth of 30 mm and a height of 20 mm and having grooves excavated from the both sides of the bottom so as to form an isosceles triangle having a height of 15 mm was buried in the resulting mixture to prepare a mold. The mold was hardened, fired in an electric oven at 1200° C. and cooled to an ordinary temperature. Molten pure titanium was cast in the mold. The results are shown in Table 9.

In this Example, the chief material was used in an amount of 90% by weight based on the whole mold material and part of the chief material, i.e. mullite was replaced with zirconium. The coloring, the seizing of the surface, the roughness and cavity (number) were determined.

TABLE 9

| Mullite | Zirconium oxide | Color | Surface | Cavity (number) | Judgement |
|---|---|---|---|---|---|
| 100% | 0% | black | remarkable seizing but removable by sand blast | 7~10 | Δ |
| 90 | 10 | " | remarkable seizing but removable by sand blast | 5~8 | Δ |
| 80 | 20 | " | seizing but smooth | 2~3 | |
| 70 | 30 | " | slight seizing | 1~2 | |
| 60 | 40 | partially bluish | smooth | 0 | |
| 50 | 50 | partially bluish | slight roughening | 0 | |
| 40 | 60 | bluish | remarkable roughening | 0 | x |

It can be understood from the above results that at most 50%, preferably 20 to 40%, of a chief material can be replaced with zirconium oxide. The addition of zirconium oxide further enhances the refractoriness of the mold to thus prevent the seizing.

This is presumably because zirconium oxide having a high temperature of 2850° C. enhances the refractory temperature of the whole mold material. Accordingly, the following substances having a high melting point can replace part of mullite or can be added as well as zirconium oxide.

| | (melting point) |
|---|---|
| spinel | 2135° C. |
| beryllium oxide | 2530° C. |
| zircon | 2850° C. |
| calcium oxide | 2570° C. |
| magnesium oxide | 2800° C. |

EXPERIMENTAL EXAMPLE 10

A mixture comprising 90% by weight of a chief material and 10% by weight of a hardening agent was ground together with water in vacuum. A test piece for testing mold strength was made of the resulting mixture, fired in an electric oven at 1200° C. and cooled to an ordinary temperature. The test piece was subjected to compressive test to determine the breaking strength. The results are shown in Table 10.

In this Example, 0 to 60% of mullite was replaced with alumina to determine the effect of the replacement.

TABLE 10

| Alumina | Mullite | Mold strength ($kg/cm^2$) (compression) | Judgement |
|---|---|---|---|
| 0 | 100 | 85 | |
| 10 | 90 | 60 | |
| 20 | 80 | 55 | |
| 30 | 70 | 35 | |
| 40 | 60 | 15 | |
| 50 | 50 | 12 | |
| 60 | 40 | 8 | x |

It can be understood from the results shown in Table 10 that the amount of alumina added must be up to 50%, because the usable mold must have a strength of 10 $kg/cm^2$ or above.

Though alumina was used in this Example. The use of silica gave results similar to the above ones.

It is evident from the above results that the mold strength is decreased by the addition of alumina to thus facilitate withdrawal of a product from the mold.

EXPERIMENTAL EXAMPLE 11

TABLE 11

| Spinel | Hardening agent (phosphate + basic metal oxide) | Mold strength | Casting surface | Tensile strength | Elongation | Hardness | Judgement |
|---|---|---|---|---|---|---|---|
| | | | | | | | x |
| 100% | 0% | unusable | — | — | — | — | x |
| 95 | 5 | usable | no seizing | 75 | 12 | 200 | |
| 90 | 10 | " | " | 75 | 12 | 200 | |
| 80 | 20 | " | " | 70 | 11 | 200 | |
| 70 | 30 | " | " | 60 | 10 | 210 | |
| 60 | 40 | " | " | 55 | 10 | 210 | |
| 55 | 45 | " | " | 50 | 8 | 220 | |
| 50 | 50 | " | slight seizing but usable | 50 | 6 | 240 | Δ |
| 45 | 55 | " | remarkable seizing | 40 | 5 | 260 | x |

Table 11 shows the mold strength, seizing of the surface, tensile strength, elongation, hardness and judgement with respect to molds prepared of a mold material comprising 45 to 100% by weight of a chief material and the balance of a hardening agent.

In the column of judgement, "x" means "unusable", "o" means "usable" and "Δ" means "slightly problematic but usable". The same applies in the following Examples.

EXPERIMENTAL EXAMPLE 12

A mixture comprising 90% by weight of a chief material and 10% by weight of a hardening agent was ground together with water in vacuum. A wax pattern having a form of a rectangular parallelpiped having a width of 20 mm, a depth of 30 mm and a height of 20 mm and having grooves excavated from the both sides of the bottom so as to form an isosceles triangle having a height of 15 mm was buried in the resulting mixture to prepare a mold. The mold was hardened, fired in an electric oven at 1200° C. and cooled to an ordinary temperature. Molten pure titanium was cast in the mold. The results are shown in Table 12.

In this Example, the amount of a chief material was 90% based on the amount of the whole mold material and part of the chief material was replaced with zirconium oxide to determine the color, seizing of the surface, roughness and cavity (number).

TABLE 12

| Spinel | Zirconium oxide | Color | Surface | Cavity (number) | Judgement |
|---|---|---|---|---|---|
| 100% | 0% | black | remarkable seizing but removable by sand blast | 7~10 | Δ |
| 90 | 10 | " | remarkable seizing but removable by sand blast | 4~7 | Δ |
| 80 | 20 | " | seizing but smooth | 2~3 | |
| 70 | 30 | " | slight seizing | 1~2 | |
| 60 | 40 | partially bluish | smooth | 0 | |
| 50 | 50 | partially bluish | slight roughening | 0 | |
| 40 | 60 | bluish | remarkable roughening | 0 | x |

It is eVident from the above results that zirconium oxide can be used in an amount of up to 50%, preferably 20 to 40%, based on the amount of a chief material. Further, the addition of zirconium oxide enhances the refractory temperature of a mold to thus prevent the seizing.

This is presumably because zirconium oxide having a melting point of 2850° C. as well as mullite enhances the refractory temperature of the whole mold material. Accordingly, the following substances having a high melting point as well as zirconium oxide can replace part of spinel and be added.

| | (melting point) |
|---|---|
| beryllium oxide | 2530° C. |
| zircon | 2850° C. |
| calcium oxide | 2570° C. |
| magnesium oxide | 2800° C. |

EXPERIMENTAL EXAMPLE 13

A mixture comprising 90% by weight of a chief material and 10% by weight of a hardening agent was ground together with water in vacuum. A test piece for testing mold strength was made of the resulting mixture, fired in an electric oven at 1200° C. and cooled. The test piece was subjected to compression test to determine the breaking strength. The results are shown in Table 13.

In this Example, 0 to 60% of spinel as a chief material was replaced with alumina to determine the effect of the replacement.

TABLE 13

| Alumina | Spinel | Mold strength (compression) ($kg/cm^2$) | Judgement |
|---|---|---|---|
| 0 | 100 | 70 | |
| 10 | 90 | 60 | |
| 20 | 80 | 45 | |
| 30 | 70 | 20 | |
| 40 | 60 | 10 | |
| 50 | 50 | 10 | |
| 60 | 40 | 5 | x |

It can be understood from the results shown in Table 13 that alumina can be added in an amount of up to 50%, because a usable mold must have a mold strength of 10 $kg/cm^2$ or above.

Though alumina was used in this Example, the use of silica or mullite gave similar results.

It is evident from the above results that the addition of alumina decreases the mold strength to thus facilitate withdrawal of a product from the mold.

What is claimed is:

1. A process for casting pure titanium or a titanium alloy, which comprises mixing 10 to 80% by weight of silica, 80 to 10% by weight of alumina, 5 to 15% by weight of a phosphate and 5 to 30% by weight of a basic metal oxide together with colloidal silica, hardening the resulting mixture while burying a wax pattern within the mixture to prepare a mold, removing the wax pattern, firing the mold at 900° C. or above to form a refractory structure comprising at least one of mullite, spinel or cordierite in the mold and casting molten pure titanium or titanium alloy in the casting space of the mold.

2. A process for casting pure titanium or a titanium alloy, which comprises mixing 95 to 55% by weight of mullite or spinel, 2.5 to 15% by weight of a phosphate and 2.5 to 30% by weight of a basic metal oxide together with colloidal silica, hardening the resulting mixture while burying a wax pattern within the mixture to prepare a mold, removing the wax pattern, firing the mold at 900° C. or above and casting molten pure titanium or titanium alloy in the casting space of the mold.

* * * * *